United States Patent [19]

Ramsey

[11] Patent Number: 4,947,605

[45] Date of Patent: Aug. 14, 1990

[54] SHRINK-WRAPPING APPARATUS AND METHOD

[75] Inventor: Harold E. Ramsey, Wilmington, Del.

[73] Assignee: E. I. Du Pont de Nemours and Company, Wilmington, Del.

[21] Appl. No.: 269,848

[22] Filed: Nov. 10, 1988

[51] Int. Cl.[5] ..... B65B 9/08; B65B 53/02

[52] U.S. Cl. ..... 53/442; 53/252; 53/450; 53/550; 53/557

[58] Field of Search ..... 53/252, 387, 442, 450, 53/543, 550, 557, 436, 526

[56] References Cited

U.S. PATENT DOCUMENTS

| | | | |
|---|---|---|---|
| 2,907,447 | 10/1959 | Offutt et al. | 53/526 X |
| 3,511,014 | 5/1970 | Kochalski | 53/436 |
| 3,818,182 | 6/1974 | Linde | 53/442 X |
| 4,141,196 | 2/1979 | Blanding | 53/550 |
| 4,377,061 | 3/1983 | Olson et al. | 53/436 X |
| 4,403,695 | 9/1983 | Raymoure et al. | 53/442 X |
| 4,419,855 | 12/1983 | Shanklin | 53/450 |
| 4,430,844 | 2/1984 | James | 53/450 |
| 4,433,527 | 2/1984 | Ramsey et al. | 53/553 X |
| 4,517,786 | 5/1985 | Barker | 53/450 |
| 4,642,969 | 2/1987 | Johnson | 53/442 X |
| 4,679,379 | 7/1987 | Cassoli | 53/450 X |
| 4,715,166 | 12/1987 | Kameda | 53/550 |

*Primary Examiner*—Robert L. Spruill
*Assistant Examiner*—Linda B. Johnson

[57] ABSTRACT

There is disclosed an apparatus for forming a shrink-wrapped package from polyolefin film which overcomes the problems of forming the bottom lap seal of the tubular package formed from the film and initial low strength of the heat seal at the forward end of the package, by positioning the static sealer for the bottom lap seal upstream from the heat sealer for the forward end of the package and by using a ram to move packages into the tubular package but to stop them short of the heat seal at the forward end of the package.

9 Claims, 3 Drawing Sheets

SHRINK-WRAPPING APPARATUS AND METHOD

BACKGROUND OF THE INVENTION

Field of the Invention

This invention relates to an apparatus and process for forming a shrink-wrapped package. References U.S. Pat. No. 4,041,674, issued to Reid on Aug. 16, 1977, discloses an apparatus for packing articles, such as bottles, in units with the articles in each unit arranged in parallel rows, each row comprising a plurality of articles arranged side-by-side, said apparatus including a means for supporting articles for arrangement in rows; means for movement in a predetermined path; a pusher for pushing rows of articles on said supporting means forward generally at right angles to the length of the rows, a guide movable forward and back with the pusher and spaced forward of the pusher a distance such as to provide a space for a row of articles therebetween, and means for feeding articles in single file one after another over said supporting means from one side through said space.

A number of patents., including U.S. Pat. Nos. 3,047,140, 3,027,300, 3,272,302, 3,326,369, 3,344,975, 3,442,436, 3,654,829, 3,804,235 and 4,586,312, disclose shrink-wrapped packages having a tear tab or perforations for ease of opening or access. U.S. Pat. No. 3,016,131, issued to Kennedy, discloses a heat-shrink package of polymeric film which is provided with a desired slit pattern which opens when stretched in the heat-shrinking process.

U.S. Pat. No. 4,139,099, issued to Daly, et al. al. on Feb. 13, 1979, discloses a shrink-wrapping kit for artwork comprising a mounting board means having a face coated with adhesive for securing the artwork to the mounting board, a shrink wrap envelope slightly larger than the mounting board means formed with a flap along one side for enclosing the mounting board with artwork attached, and means for sealing the envelope flap to the envelope. The patent discloses that 150 gauge shrink film is preferred, such as W.R. Grace's "Cryovac" film, Reynolds' "Reynolon" film, and Du Pont's "Clysar" polyolefin film.

Numerous apparatus have been developed for forming shrink- wrapped packages. In one such device, a film sheeting is unwound from a roll by a powered unwind/dancer roll system through a pneumatic hole punch assembly and to a film former. Film is formed into a rectangular tube with a bottom overlap as it follows the geometry of the former. A start-up vertical heat seal is made by separate energizing of the heat sealer thereby closing the end of the film. Cartons are queued on a constantly running infeed conveyor. When a preselected number of cartons at the head queue are in an appropriate position, a proximity switch is energized thereby activating a pusher which moves the preselected number of cartons transversely to a center line above a ram. When the ram is fully retracted, the preselected number of cartons drop to the same elevation as and in front of the ram. On its forward stroke, the ram pushes the cartons through the former so that the forward most carton strikes the start-up vertical seal and thereby pulls the film forward. At the end of this stroke, the last carton has passed the heat sealer with sufficient clearance to permit activation of the heat sealer to complete the rear seal of the package and the start-up seal of the next package. On return of the stroke of the ram, the heat sealer closes to form the end seals. Upon opening of the sealer, a conveyor is activated to transfer the resulting package into a continually running heat shrink tunnel.

Operation of the foregoing prior art device requires a low shrink force packaging material, such as polyvinyl chloride, with an ability to block or mat and form a bottom lap seal in the heat tunnel. Also, high slip over the film former and quick setting of the vertical heat seal is critical to withstanding the impact and film advancement of the forward stroke of the ram. When attempts are made to use high shrink force films, such as polyolefin films, in this prior art apparatus, it was found that the polyolefin film package failed to form a bottom seal when it went through the heat shrink tunnel. Thus, there is a need for an apparatus that will shrink-wrap package an array of articles using a single web of polyolefin film.

SUMMARY OF THE INVENTION

The present invention provides an apparatus for forming a shrink-wrapped package from a polyolefin film comprising (a) means for rotatably mounting a roll of polyolefin film;

(b) means for unwinding polyolefin film from the roll;

(c) means for forming said film into a tube with overlap of the film edges;

(d) means for statically sealing the edges of the film together in the tube area for a preselected length sufficient to accomodate a preselected number of articles;

(e) means for making heat seals near one end of the tube and separation of the film at the seals, said seals forming a front end of one package and a back end of another;

(f) means for moving a preselected number of articles in one or more single-file arrays into registry with the other end of the tube;

(g) means for moving the articles through the forming means into the tube past the static sealing means so that the forward end of the first article is just short of the heat seals;

(h) a first upper and lower conveyor means on the entrance side and a second upper and lower conveyor means on the exit side of the sealing means to receive the tube containing the articles and to provide compression on the filled tube section, said first conveyor means providing movement of the filled tube section beyond the heat sealing means and onto the second conveyor means while pulling additional film through the tube forming means, and each upper conveyor means being vertically moveable so as to facilitate acceptance to the tubing; and (i) a heat shrink tunnel to receive and heat shrink the film around the resulting wrapped package, the second conveyor means providing movement of the resulting wrapped package into the heat shrink tunnel after a heat seal has been formed for the next package and thereby providing heat sealing of the other end of the wrapped package, said tunnel having hot air flowing from above and below said wrapped package.

The invention also provides a method of forming the shrink-wrapped package.

DETAILED DESCRIPTION OF THE INVENTION

Figure 1:
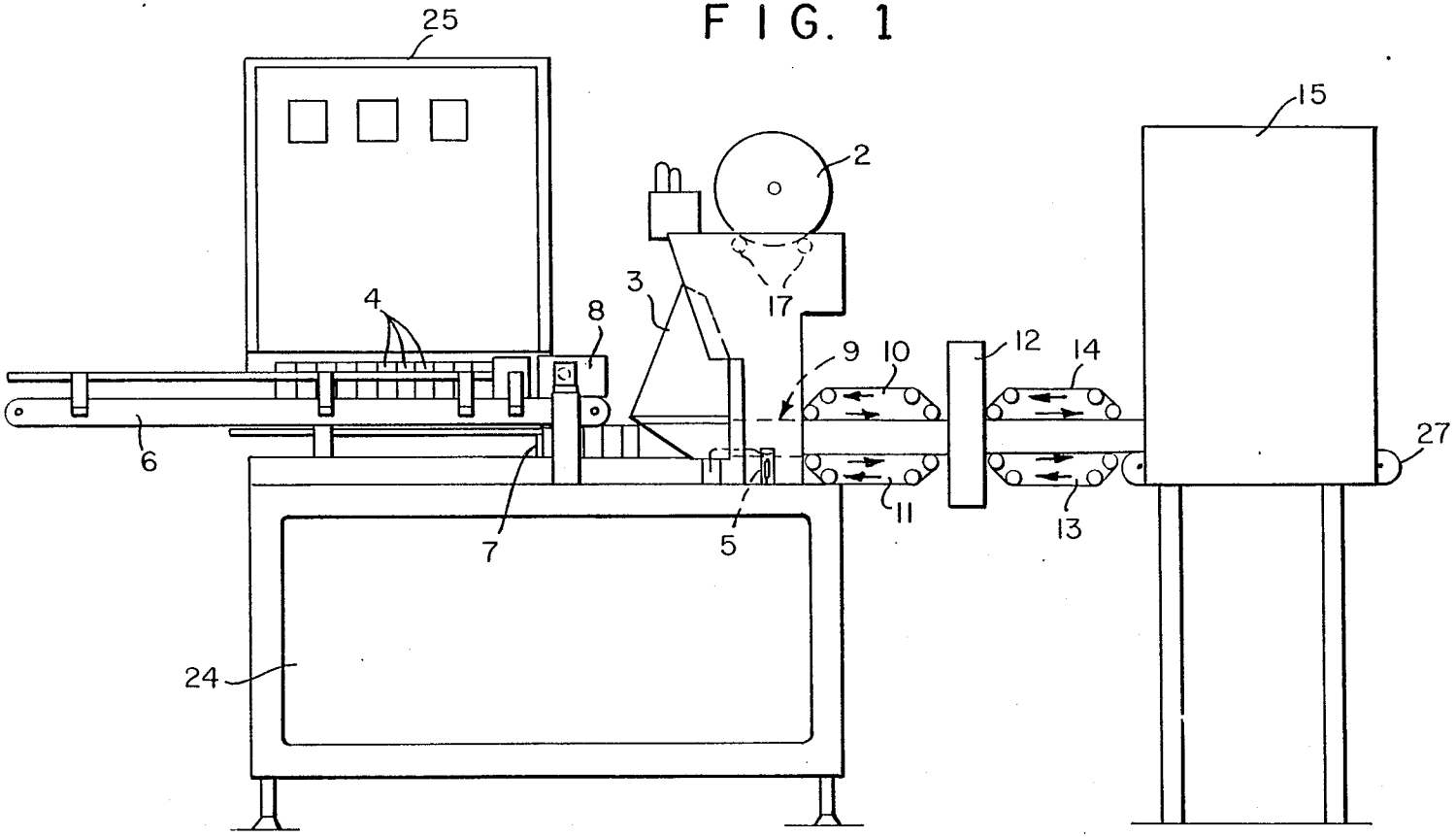
FIG. 1 is an elevational side view of the apparatus of the invention.

Referring to FIG. 1, film from roll 2 which is rotatably mounted on cradle rolls 17 is passed through film former 3 to provide rectangular film tube 9 having overlap of the film edges. The edges of rectangular film tube 9 are threaded through static sealer 5 and pulled through heat sealer 12 where a start-up seal is made by energization of the heat sealer. Heat sealer 12 also separates the film at the seal, and excess film is manually removed. Cartons 4 are queued on constantly running feed conveyor 6. When the first three cartons at the head of queue are in an appropriate position a proximity switch (not shown) is energized which activates pusher 8 and these three cartons are pushed transversely to a center line above and in front of ram 7. This is done during operation while ram 7 is retracting.

After ram 7 is fully retracted, the three cartons drop to the same elevation as and in front of the ram. Ram 7 brings cartons 4 forward through the former 3, into the film tube 9, past static sealer 5 and onto conveyor 11 and stops at a predetermined position such that the leading face of the most forward carton stops just short of striking the heat seal. Conveyors 10 and 14 are raised prior to the incoming cartons reaching conveyor 10. As ram 7 is retracted, conveyor 10 is lowered and conveyors 10, 11, 13 and 14 start in the indicated motion. Conveyor 14 is lowered slightly later than conveyor 10 to provide smooth transfer of the leading top surface of the front carton into the compression section of conveyors 13 and 14. As cartons 4 are transferred from conveyor 11 to conveyor 13, additional film tube is pulled through the film former and the static sealer by compression of the film between the belts and cartons and the forward motion of the package.

As the transfer of the cartons to conveyor 13 is completed heat sealer 12 is activated to produce seals at the back of the package and the front of the next package. Just prior to closing of the heat sealer, conveyors 10 and 14 are raised to reduce tension. Heat sealer 12 remains closed until near the end of the forward stroke of ram 7. On the next operating cycle of the apparatus, the package on conveyor 13 is advanced into the shrink tunnel 15 and conducted through the tunnel on conveyor 27.

The apparatus has a frame 24 to which the elements are attached and a controller 25 to provide proper timing of its functional steps.

Figure 2:
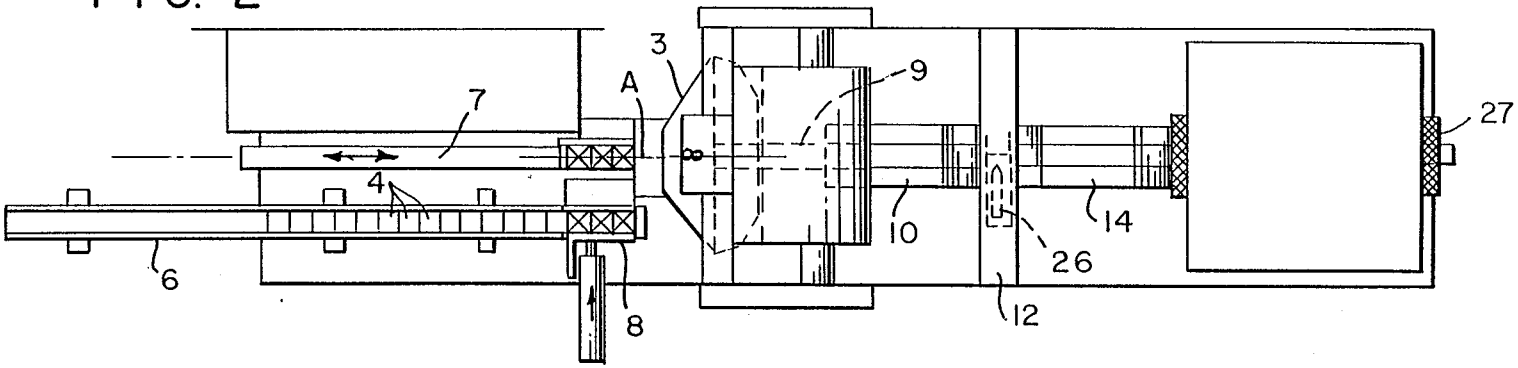
FIG. 2 is a top view of the apparatus of the invention.
Figure 3:
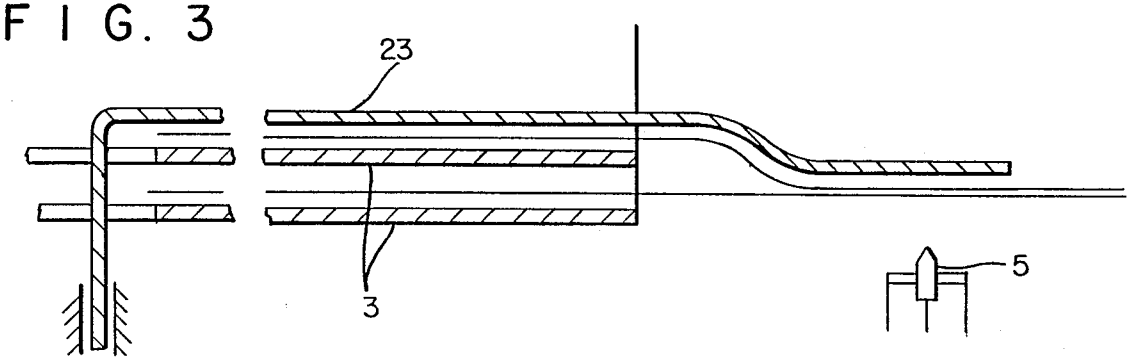
FIGS. 3 and 4 are a view of the film former and a sectional view of the tongue plate, respectively.
Figure 4:
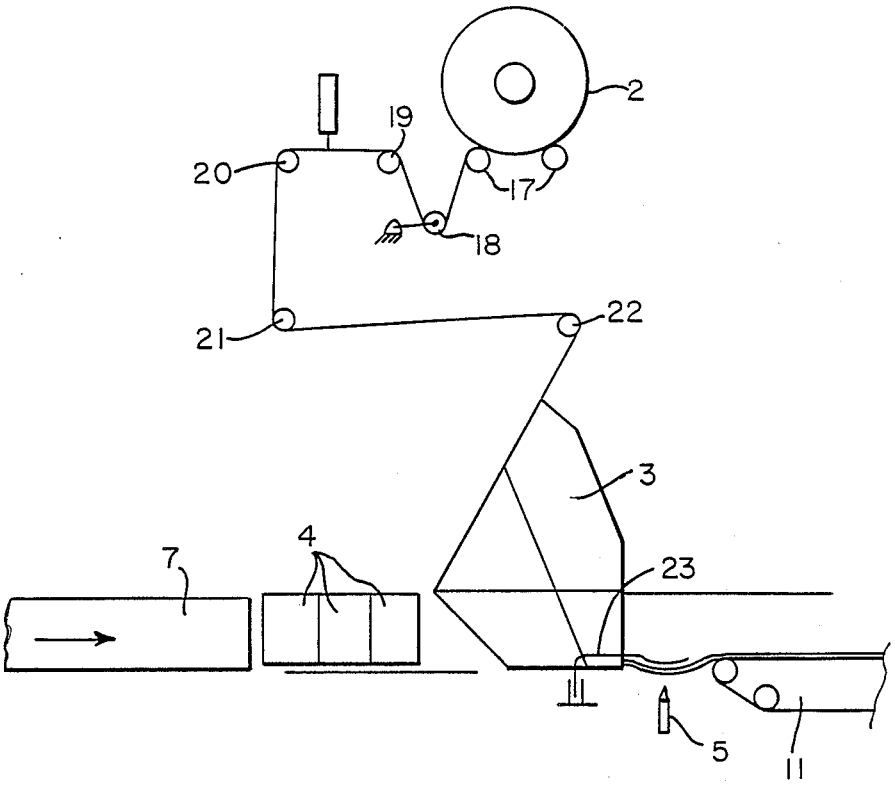

Referring to FIG. 2, pusher 8 is activated to push transversely cartons 4 to center line A above ram 7. Referring now to FIGS. 3 and 4, film 2 is passed over rollers 17-22 and former 3 to form rectangular film tube 9. The edges of the film tube are passed through static sealer 5. It is to be understood that as used herein the terms "static sealing" and "static sealer" refer to electrostatic charging of the film overlap to create adhesion of the edges to each other. Preferably, the edges are fed under tongue plate 23 prior to passing over the static sealer. Tongue plate 23 maintains continuity of the overlap of film edges through the static seal step. The tongue plate is inserted in the film tube former in cantilever support and is above the overlap of the film edges. Also, positioning the tongue plate above the film overlap assures that neither edge can work its way above the plate.

In a preferred embodiment, the heat sealer is a heated blade 26 (FIG. 2) with film clamps acting against a silicone rubber backup pad. This configuration produces two bead seals, one on each side of the blade which not only heat seals but severs the two film sections. Preferably the heat sealer is vertically mounted. The heat shrink tunnel 15 (FIG. 1) provides hot air flowing from above and below the package, thereby providing more uniform and complete shrinkage. Preferably, the heat shrink tunnel uses a wire conveyor belt 27 (FIG. 1) to provide high air passage and belt durability.

Besides a ram, the means for moving the articles through the forming means can be a lug conveyor, or any other suitable system. If said means is a ram, it can be operated by a gear system which imparts a forward stroke and reverse stroke to it. Pusher 8 can be operated by a pneumatic cylinder. In another embodiment of the invention pusher 8 and ram 7 are at the same elevation.

The apparatus of the invention provides a shrink-wrapped package using polyolefin film. Suitable films include polypropylene film, polyethylene film, copolymers of propylene and ethylene, ethylene vinyl acetate copolymers, and blends of the foregoing, and terpolymers of ethylene, propylene and butene. If the film is made from a terpolymer, preferably the terpolymer has 92% propylene, 3% ethylene, and 5% butene. The apparatus can also be used with polyvinyl chloride film, but preferably, the film used is polypropylene. For each of the usable films, the speed of the conveyor and the temperature of the heat shrink tunnel must be appropriately adjusted to provide the desired heat sealing. Preferably, the tube formed is rectangular. Although, the invention has been illustrated by describing how it would be used to wrap cartons, it is to be appreciated that the invention is applicable to any articles of uniform size. The number of articles wrapped in a package is not critical, and even two rows of articles can be used. Preferably, the number of articles is three or six. For the latter, pusher 8 is adjusted to make a partial push of a first row of articles to an intermediate position short of dropping in front of the ram. Then a full push of a second row is made by pushing the two rows to a position where all the articles drop in front of ram 7.

The apparatus of the invention can be used to provide a printed package by utilizing preprinted film. The use of preprinted film is controlled by providing for forward movement of the film a distance greater than the print repeat length. A sensor can be used to detect when the printed pattern has reached the desired position relative to the cartons and heat sealer. Using a clutch/-brake system to run upper and lower conveyors 10, 11 and 13, 14, the sensor will de-energize the clutch and activate the brake when the correct position is detected. The sensor is placed after the static sealer one repeat distance from the heat sealer. Also, a rotating package flipper bridge or platform can be placed in the heat sealer at the level of conveyor 11 to facilitate transfer of the articles through the heat sealer.

The present invention also provides a method of forming a shrink-wrapped package from a polyolefin film comprising (a) forming the film into a tube with overlap of film edges; (b) sealing statically the edges of the film together to accommodate a preselected number of articles; (c) heat sealing near one end of the tube and separating the film at the seal to form a front end of one package and a back end of another; (d) moving a preselected number of articles in one or more single-file arrays into registry with the other end of the tube; (e) pushing the articles into the tube beyond the beginning of the static seal so that the forward end of the first article is just short of the heat seal; (f) transporting the resulting filled tube section with upper and lower compression through a first stage thereby providing movement of said filled tube section a preselected distance and then, after a heat seal has been formed for the next package and thereby providing heat sealing and separation of the other end of the wrapped package, through a second stage; and (g) heat shrinking the film around the resulting package in the second stage, said heat shrinking being effected by flow of hot air above and below the wrapped package.

The Invention Being claimed Is:

1. An apparatus for forming a shrink-wrapped package from a polyolefin film comprising (a) means for rotatably mounting a roll of polyolefin film;

(b) means for unwinding polyolefin film from the roll;

(c) means for forming said film into a tube with overlap of the film edges;

(d) means for statically sealing the edges of the film together in the tube area for a preselected length sufficient to accommodate a preselected number of articles;

(e) means for making heat seals near one end of the tube and separation of the film at the seals, said seals forming a front end of one package and a back end of another;

(f) means for moving a preselected number of articles in one or more single-file arrays into registry with the other end of the rectangular tube;

(g) ram means for moving the articles through the forming means into the tube while stationary past the static sealing means so that the forward end of the first article is just short of the heat seals;

(h) a first upper and lower conveyor means on the entrance side and a second upper and lower conveyor means on the exit side of the sealing means to receive the tube containing the articles and to provide compression on the filled tube section, said first conveyor means providing movement of the filled tube section beyond the heat sealing means and onto the second conveyor means while pulling additional film through the tube forming means, and each upper conveyor means being vertically moveable so as to facilitate acceptance to the tubing and articles; and (i) a heat shrink tunnel to receive and heat shrink the film around the resulting wrapped package, the second conveyor means providing movement of the resulting wrapped package into the heat shrink tunnel after a heat seal has been formed for the next package and thereby providing heat sealing of the other end of the wrapped package, said tunnel having hot air flowing from above and below said wrapped package.

2. The apparatus of claim 1 wherein the shrink tunnel has an open wire conveyor belt for transporting the wrapped package therethrough.

3. The apparatus of claim 1 wherein the heat sealing means has a vertically mounted heated blade.

4. The apparatus of claim 3 wherein the tube formed is rectangular.

5. The apparatus of claim 4 wherein the articles are cartons.

6. The apparatus of claim 5 wherein the film is a copolymer of ethylene and propylene.

7. A method of forming a shrink-wrapped package from polyolefin film comprising (a) forming the film into a tube with overlap of the film edges;

(b) sealing statically the edges of the film together in the tube area for a preselected length sufficient to accommodate a preselected number of articles;

(c) heat sealing near one end of the tube and separating the film at the seal to form a front end of one package and a back end of another;

(d) moving a preselected number of articles in one or more single-file arrays into registry with the other end of the tube;

(e) pushing the articles into the tube while free of upper and lower compression beyond the beginning of the static seal so that the forward end of the first article is just short of the heat seal;

(f) transporting the resulting filled tube section with upper and lower compression through a first stage thereby providing movement of said filled tube section a preselected distance and then, after a heat seal has been formed for the next package and thereby providing heat sealing and separation of the other end of the wrapped package, through a second stage; and (g) heat shrinking the film around the resulting wrapped package in the second stage, said heat shrinking being effected by a flow of hot air above and below said wrapped package.

8. The method of claim 7 wherein the film is a copolymer of ethylene and propylene.

9. The method of claim 8 wherein the tube formed is rectangular.

* * * * *